US009719683B2

(12) United States Patent
Cox et al.

(10) Patent No.: US 9,719,683 B2
(45) Date of Patent: Aug. 1, 2017

(54) MODULATED POWER BURNER SYSTEM AND METHOD

(75) Inventors: Donald W. Cox, Fort Wayne, IN (US); Syed Mohammad Shiblee Noman, Fort Wayne, IN (US)

(73) Assignee: Wayne/Scott Fetzer Company, Fort Wayne, IN (US)

( * ) Notice: Subject to any disclaimer, the term of this patent is extended or adjusted under 35 U.S.C. 154(b) by 1793 days.

(21) Appl. No.: 12/869,291

(22) Filed: Aug. 26, 2010

(65) Prior Publication Data

US 2010/0319551 A1 Dec. 23, 2010

Related U.S. Application Data

(62) Division of application No. 11/738,111, filed on Apr. 20, 2007, now Pat. No. 8,075,304.

(60) Provisional application No. 60/862,131, filed on Oct. 19, 2006.

(51) Int. Cl.
*F23N 1/04* (2006.01)

(52) U.S. Cl.
CPC ..... *F23N 1/045* (2013.01); *F23N 2033/08* (2013.01); *F23N 2033/10* (2013.01)

(58) Field of Classification Search
USPC ..... 431/12, 89, 90
See application file for complete search history.

(56) References Cited

U.S. PATENT DOCUMENTS 2,329,211 A 9/1943 Morton
2,799,491 A 7/1957 Rusciano
3,054,607 A 9/1962 Hoyt et al.
3,123,027 A 3/1964 Livingston
3,259,316 A * 7/1966 Wright et al. ..... 236/92 A
3,284,615 A 11/1966 Yetter
3,345,846 A 10/1967 Hess
3,416,509 A 12/1968 Huebler et al.
3,528,399 A 9/1970 Perl
3,590,805 A 7/1971 Perl
3,616,274 A 10/1971 Eddy
3,868,211 A 2/1975 Haye et al.
(Continued)

FOREIGN PATENT DOCUMENTS

EP 1176367 A1 1/2002
JP 04036508 A * 2/1992
(Continued)

*Primary Examiner* — Jorge Pereiro

(74) *Attorney, Agent, or Firm* — Wood Herron & Evans LLP

(57) ABSTRACT

A power burner system for use with a heating appliance includes a burner tube, a gas valve for providing gas to the burner tube, and a variable speed combustion air blower for mixing air with the gas provided to the burner tube. The burner system further includes a control in communication with the gas valve and the combustion air blower. The control may also be in communication with various other devices of an appliance, such as a variable speed air-circulating fan, a variable speed exhaust fan, or various sensors associated with the heating appliance. The control modulates the gas valve and the combustion air blower to maintain substantially stoichiometric conditions of the gas and air provided to the burner tube and as a function of signals from at least one of the devices. In one embodiment, the burner system may be used in a conveyor oven.

11 Claims, 5 Drawing Sheets

(56) References Cited

U.S. PATENT DOCUMENTS

| | | | | | |
|---|---|---|---|---|---|
| 4,043,742 | A | | 8/1977 | Egan et al. | |
| 4,044,751 | A | | 8/1977 | Johnson | |
| 4,090,839 | A | | 5/1978 | von Linde et al. | |
| 4,100,741 | A | | 7/1978 | Michels | |
| 4,113,417 | A | | 9/1978 | Deruelle | |
| 4,118,172 | A | * | 10/1978 | Noir et al. | 431/12 |
| 4,162,141 | A | * | 7/1979 | West | 432/144 |
| 4,204,830 | A | | 5/1980 | Jones et al. | |
| 4,221,557 | A | | 9/1980 | Jalics | |
| 4,249,890 | A | | 2/1981 | Graham | |
| 4,334,855 | A | | 6/1982 | Nelson | |
| 4,340,355 | A | | 7/1982 | Nelson et al. | |
| 4,357,522 | A | * | 11/1982 | Husslein et al. | 219/400 |
| 4,373,662 | A | * | 2/1983 | Bassett et al. | 236/10 |
| 4,373,897 | A | | 2/1983 | Torborg | |
| 4,406,611 | A | | 9/1983 | Michel | |
| 4,421,268 | A | * | 12/1983 | Bassett et al. | 236/10 |
| 4,468,192 | A | | 8/1984 | Jaeger | |
| 4,474,549 | A | | 10/1984 | Capone | |
| 4,482,313 | A | | 11/1984 | Cheetham | |
| 4,484,561 | A | * | 11/1984 | Baggott et al. | 126/21 A |
| 4,509,913 | A | | 4/1985 | Lorenz et al. | |
| 4,533,315 | A | | 8/1985 | Nelson | |
| 4,588,372 | A | | 5/1986 | Torborg | |
| 4,622,004 | A | | 11/1986 | Dalhuisen | |
| 4,624,301 | A | * | 11/1986 | Baggott et al. | 165/47 |
| 4,645,450 | A | | 2/1987 | West | |
| 4,676,734 | A | | 6/1987 | Foley | |
| 4,688,547 | A | | 8/1987 | Ballard et al. | |
| 4,717,071 | A | | 1/1988 | Capone | |
| 4,793,798 | A | | 12/1988 | Sabin | |
| 4,813,398 | A | * | 3/1989 | Savage | 126/21 A |
| 4,830,600 | A | | 5/1989 | VerShaw et al. | |
| 4,830,601 | A | | 5/1989 | Dahlander et al. | |
| 4,978,292 | A | | 12/1990 | Donnelly et al. | |
| 4,994,959 | A | | 2/1991 | Ovenden et al. | |
| 5,037,291 | A | | 8/1991 | Clark | |
| 5,160,259 | A | | 11/1992 | O'Hara et al. | |
| 5,203,315 | A | | 4/1993 | Clawson et al. | |
| 5,222,887 | A | | 6/1993 | Zabielski, Sr. | |
| 5,275,554 | A | | 1/1994 | Faulkner | |
| 5,280,756 | A | | 1/1994 | Labbe | |
| 5,285,959 | A | * | 2/1994 | Nanba et al. | 236/11 |
| 5,297,959 | A | | 3/1994 | Hemsath | |
| 5,321,744 | A | | 6/1994 | Madonna et al. | |
| 5,395,230 | A | | 3/1995 | Ferguson | |
| 5,524,606 | A | * | 6/1996 | Le Strat | 126/99 R |
| 5,556,273 | A | | 9/1996 | Mangham et al. | |
| 5,560,542 | A | | 10/1996 | Reid | |
| 5,590,642 | A | | 1/1997 | Borgeson et al. | |
| 5,636,786 | A | * | 6/1997 | Daneshvar et al. | 236/11 |
| 5,658,140 | A | | 8/1997 | Kondou et al. | |
| 5,667,375 | A | | 9/1997 | Sebastiani | |
| 5,685,707 | A | | 11/1997 | Ramsdell et al. | |
| 5,793,019 | A | * | 8/1998 | Boyle et al. | 219/400 |
| 5,865,611 | A | | 2/1999 | Maiello | |
| 5,865,618 | A | * | 2/1999 | Hiebert | 432/222 |
| 5,957,063 | A | | 9/1999 | Koseki et al. | |
| 5,971,745 | A | | 10/1999 | Bassett et al. | |
| 5,993,195 | A | | 11/1999 | Thompson | |
| 5,997,278 | A | | 12/1999 | Sutton | |
| 5,997,280 | A | | 12/1999 | Welz, Jr. et al. | |
| 6,019,593 | A | | 2/2000 | Lewandowski et al. | |
| 6,082,993 | A | | 7/2000 | O'Leary et al. | |
| 6,113,384 | A | | 9/2000 | Sebastiani | |
| 6,183,246 | B1 | | 2/2001 | Le Goueffec | |
| 6,190,160 | B1 | | 2/2001 | Hibon et al. | |
| 6,213,758 | B1 | | 4/2001 | Tesar et al. | |
| 6,247,919 | B1 | | 6/2001 | Welz, Jr. et al. | |
| 6,295,937 | B1 | * | 10/2001 | Nakanishi et al. | 110/190 |
| 6,371,752 | B1 | | 4/2002 | Kuroda et al. | |
| 6,481,433 | B1 | | 11/2002 | Schjerven, Sr. et al. | |
| 6,537,059 | B2 | | 3/2003 | Lochschmied | |
| 6,609,907 | B1 | | 8/2003 | Wood et al. | |
| 6,736,634 | B2 | | 5/2004 | Manohar et al. | |
| 6,776,609 | B1 | | 8/2004 | Sullivan et al. | |
| 6,866,202 | B2 | | 3/2005 | Sigafus et al. | |
| 6,866,502 | B2 | | 3/2005 | Stephens | |
| 6,877,980 | B2 | | 4/2005 | Stephens et al. | |
| 6,943,324 | B2 | * | 9/2005 | Ahuja | 219/446.1 |
| 7,025,810 | B2 | | 4/2006 | Crawley et al. | |
| 7,048,537 | B2 | * | 5/2006 | Jaeschke et al. | 431/28 |
| 7,109,447 | B2 | * | 9/2006 | Goranson | 219/501 |
| 7,293,718 | B2 | * | 11/2007 | Sigafus et al. | 236/11 |
| 8,246,757 | B2 | * | 8/2012 | Nowack | 134/19 |
| 8,413,646 | B2 | * | 4/2013 | Wiker et al. | 126/21 A |
| 2003/0059730 | A1 | * | 3/2003 | Sigafus et al. | 431/18 |
| 2004/0200825 | A1 | * | 10/2004 | Ahuja | 219/446.1 |
| 2005/0159844 | A1 | * | 7/2005 | Sigafus et al. | 700/275 |
| 2005/0236388 | A1 | * | 10/2005 | Goranson | 219/400 |
| 2006/0078836 | A1 | | 4/2006 | Kim et al. | |
| 2007/0006865 | A1 | * | 1/2007 | Wiker et al. | 126/21 A |
| 2007/0289589 | A1 | * | 12/2007 | McFarland | 126/502 |
| 2008/0087175 | A1 | * | 4/2008 | Henke et al. | 99/443 C |
| 2009/0223503 | A1 | * | 9/2009 | Wiker et al. | 126/21 A |
| 2013/0000628 | A1 | * | 1/2013 | Wiker et al. | 126/21 A |

FOREIGN PATENT DOCUMENTS

| | | | |
|---|---|---|---|
| WO | 8601581 | A1 | 3/1986 |
| WO | WO 2005023006 | A2 * | 3/2005 |

* cited by examiner

MODULATED POWER BURNER SYSTEM AND METHOD

CROSS REFERENCE TO RELATED APPLICATIONS

This application is a divisional of U.S. patent application Ser. No. 11/738,111, filed Apr. 20, 2007 (pending), which claims the priority of U.S. Provisional Patent Application Ser. No. 60/862,131, filed Oct. 19, 2006, the disclosures of which are hereby incorporated by reference herein in their entirety.

TECHNICAL FIELD

The present invention relates generally to gas burners for heating, and more particularly to a powered burner for use in heating appliances.

BACKGROUND OF THE INVENTION

Powered gas burners are heating devices that utilize a fan or blower to mix combustion air with gas from a supply and to direct the air/gas mixture to a burner tube at a pressure that is higher than atmospheric pressure. Powered burners are therefore distinguishable from atmospheric burners which rely solely on the static pressure of gas from a supply to provide an air/gas mixture at burner outlets where the air/gas mixture may be ignited to create a flame. Powered gas burners are also distinguishable from "induced draft" burners which utilize a fan at an exhaust location to create a negative pressure within the burner, thereby drawing additional airflow from the environment into the combustion chamber to mix with the gas from a supply. While such induced draft systems may be able to achieve higher ratios of air in the combustion chamber, these systems still rely upon available air from the environment and therefore may provide inconsistent efficiencies of combustion.

Powered burners are therefore capable of providing all of the air needed for combustion directly to the air/gas mixture exiting the burner outlets. Powered burners are generally used in heating appliances, such as, but not limited to, commercial cooking ovens and other systems where there is insufficient ambient air to ensure complete combustion. It is generally desirable to operate burner systems such that complete combustion of the air/gas mixture is achieved, as this provides efficient operation and high heat output. The optimum ratio of air and gas required for complete combustion is referred to as stoichiometric conditions. Powered burners are particularly advantageous in appliances such as ovens, griddles, grills, or furnaces, where the burner is disposed within an enclosure where a sufficient supply of atmospheric air is not available for complete combustion.

While various types of controllable burner systems are available, many conventional systems only regulate the flow of gas into a burner and therefore are not able to provide efficient combustion across the entire operating range of the appliance in which they are used. Other conventional systems are able to provide varied air and gas flow only at discreet, selected speeds, such as a high speed and a low speed. These systems are also not configured to provide efficient operation over the operating range between the high and low settings.

A need therefore exists for burner systems which are able to provide efficient combustion over the entire operating range of the appliances in which they are used.

BRIEF SUMMARY OF THE INVENTION

The present invention overcomes the foregoing and other shortcomings and drawbacks of burner systems heretofore known for use in various environments and applications. While various embodiments are discussed in detail herein, it will be understood that the invention is not limited to these embodiments. On the contrary, the invention includes all alternatives, modifications and equivalents as may be included within the spirit and scope of the present invention.

In one aspect, a powered burner system for use with a heating appliance includes a burner tube, a gas valve for supplying gas to the burner tube, and a variable speed combustion air blower for mixing combustion air with the gas provided to the burner tube. A control is in communication with the gas valve and the combustion air blower and modulates the gas valve and combustion air blower to maintain substantially stoichiometric conditions of the air and gas flow into the burner tube. In one embodiment, the burner system includes a sensor adapted to sense a speed of the combustion air blower, and the control modulates the combustion air blower in response to signals from the sensor related to the sensed speed.

In another embodiment, the control modulates the combustion air blower to a reduced speed and modulates the gas valve to track a gradually reducing speed of the combustion air blower when a demand for lower heat output is received by the system. When the gas valve is within a predetermined range of a final, desired gas valve position that corresponds to the lower heat output, the control may move the gas valve directly to the desired position. Accordingly substantially stoichiometric conditions are maintained as the gas valve tracks the combustion air blower speed, but excessive delay in attaining the desired lower heat output is avoided by moving the gas valve to the desired position once the gas valve is within the predetermined range.

In another embodiment, the heating appliance in which the burner system is used may include a variable speed air-circulating fan, a variable speed exhaust fan, or sensors for sensing various parameters associated with the operation of the heating appliance. For example, some sensors may be configured to sense the rotational speed of the combustion air blower, the air-circulating fan, or the exhaust fan. Other sensors may be configured to sense a temperature or the presence of oxygen, carbon monoxide, or carbon dioxide. Modulation of the gas valve and the combustion air blower may be a function of the speed of the air-circulating fan, the speed of the exhaust fan, or signals from the sensors. The controller may also be adapted to control the speeds of the air-circulating fan or the exhaust fan in response to signals received from the sensors.

In another aspect, the burner system may include a memory configured to store information related to the operation of the burner system. In one embodiment, the memory may be configured to store information related to a voltage corresponding to a speed of the combustion air blower. In another embodiment, the memory may be configured to store information related to a stall condition of the combustion air blower.

In another aspect, a conveyor oven includes a power burner system having one or more of the features described above. The conveyor oven has first and second cooking chamber doors that are movable between open conditions that permit access to the cooking chamber, and closed conditions that inhibit access to the cooking chamber. The control operates to control the gas valve and the combustion air blower as a function of at least one of the conditions wherein one or both of the cooking chamber doors are open or closed.

The above and other objects and advantages of the present invention shall be made apparent from the accompanying drawings and the description thereof.

The accompanying drawings, which are incorporated in and constitute a part of this specification, illustrate exemplary embodiments of the invention and, together with a general description of the invention given above, and the detailed description given below, serve to explain the invention in sufficient detail to enable one of ordinary skill in the art to which the invention pertains to make and use the invention.

DETAILED DESCRIPTION OF THE INVENTION

Figure 1:
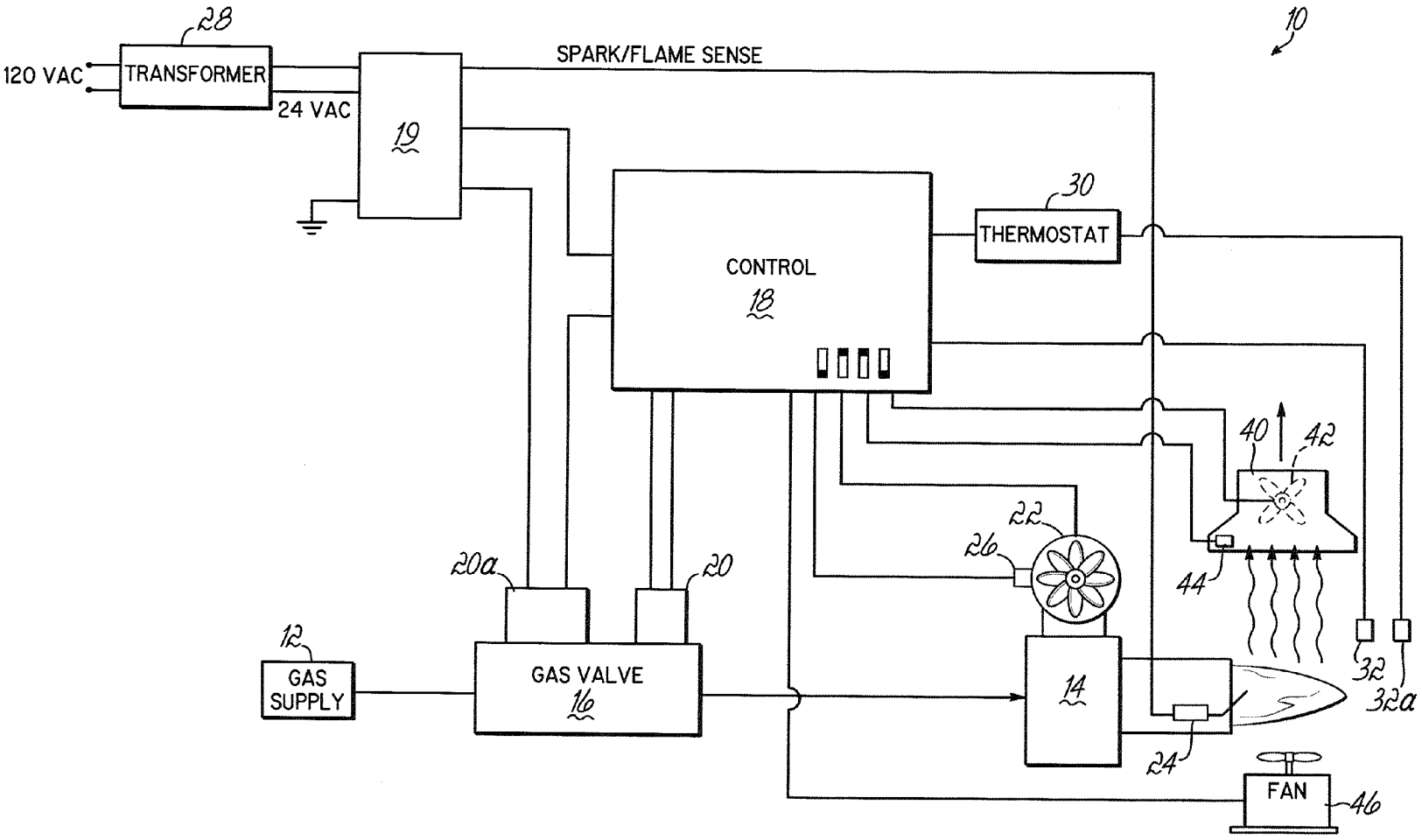
FIG. 1 is a schematic illustration depicting a controllable powered gas burner system in accordance with the principles of the present invention.

FIG. 1 is a schematic illustration depicting an exemplary embodiment of a powered gas burner system 10. Pressurized gas from a supply 12 is directed to a burner 14 through a modulating gas valve 16 that is in communication with a control 18. The control 18 sends signals to the gas valve 16 to cause the valve to move to a desired position and thereby provide a desired gas flow rate to the burner 14. For example, in the embodiment shown, the gas valve 16 includes a solenoid 20 that receives a voltage or other signal from the control 18 to cause the gas valve 16 to move to a desired valve position. The gas valve 16 may further include a second solenoid 20*a* configured to place the valve in either an open condition or a closed condition. The second solenoid 20*a* communicates with an ignition control 19 that is in communication with an ignition device 24. Ignition control 19 sends a signal to the second solenoid 20*a* to place the valve in an open condition only when a flame is detected by the ignition device 24, thereby preventing the flow of gas to the burner 14 when the burner 14 is not lit.

Alternatively, control 18 may be configured to sense a position of the gas valve 16 between a fully open position and a fully closed position. In such an embodiment, the control 18 sends signals to the gas valve 16 to cause the valve to move to a desired position and thereby provide a desired gas flow rate to the burner 14.

The burner system 10 further includes a variable speed combustion air blower 22 operatively coupled to the burner 14 and configured to provide air to the burner 14 at a pressure higher than atmospheric air. Air from the combustion air blower 22 and gas from the supply 12 is mixed in the burner 14 and is ignited, for example, by ignition device 24. The combustion air blower 22 is also in communication with the control 18. The control 18 senses a speed of the combustion air blower 22 and sends signals to the combustion air blower 22 to cause the combustion air blower 22 to operate at a desired speed. For example, the combustion air blower 22 may be provided with a non-contact sensor 26, such as a Hall Effect Sensor or any other type of sensor suitable to sense a rotational speed of the combustion air blower 22. The sensor 26 sends a signal to the control 18 that corresponds to the speed of the combustion air blower 22. The control 18 may send a command signal to operate the combustion air blower 22 at a desired speed and thereafter monitor the signal from the blower sensor 26 to determine if the combustion air blower 22 is operating at the commanded speed. If the blower speed is too fast or too slow, the control 18 may adjust the speed accordingly. Based on the performance characteristics of the combustion air blower 22, the volume of air output at a particular speed can be determined.

While various components are described herein as a "blower" or a "fan", it will be appreciated that various other devices for providing a desired air flow may alternatively be used. Accordingly, the description of particular components as a blower or a fan is not intended to be limiting and various other devices suitable to provide air flow may be used.

The control 18 may be configured to adjust the position of the gas valve 16 and the speed of the combustion air blower 22 such that the air/gas mixture is provided to the burner 14 at substantially stoichiometric conditions, thereby assuring complete combustion. For example, the control 18 may be configured such that the combustion air blower 22 provides slightly more air than is required for stoichiometric conditions, thereby ensuring complete combustion or, alternatively, a slightly excess amount of air such that carbon monoxide in the products of combustion is reduced or eliminated. In one embodiment, control 18 may be configured to provide up to approximately 10% excess air. In another embodiment, control 18 may be configured to provide approximately 5% to approximately 10% excess air.

The burner system 10 further includes a transformer 28 which may be coupled to a source of electricity, such as a standard 120 volt AC source. The transformer 28 may step down the voltage, for example to 24 volts AC, or to any other voltage as may be desired for use by the burner system 10. Electric current may thereby be routed to the various devices of the burner system 10 under the direction of the control 18. The control 18 may be programmable, or may be configured to receive input, such as by the utilization of DIP switches which permit the control 18 to be selectively configured for operation as may be desired.

The burner system 10 may further include a thermostat 30 in communication with the control 18 to provide input signals corresponding to a heat demand required from the system. In response to a demand for heat from the thermostat 30, the control 18 determines the position of the gas valve 16 and the speed of the combustion air blower 22 needed to provide the requested heat output, with the gas and air being provided to the burner 14 at substantially stoichiometric conditions. In one embodiment, the burner system 10 may include a memory in which a look-up table of various gas valve positions and combustion air blower speeds are stored and which correspond to various heat demands received as input from the thermostat 30. The look-up table may be unique to a particular appliance, or even to a particular model of appliance in which the burner system 10 is used. Accordingly, the table may be experimentally determined by appropriate testing of the particular appliance throughout the range of operation of the appliance.

The burner system 10 may further include a sensor 32 positioned near the combustion chamber and configured to sense the conditions of the combustion products. For example, the sensor 32 may be a temperature sensor which senses the temperature of the combustion products. Alternatively, the sensor 32 may be an oxygen sensor which senses the level of oxygen in the combustion products. Signals from the sensor 32 may be communicated to the control 18 to provide an indication of the quality and efficiency of the combustion. In response to the signals from the sensor 32, the control 18 may adjust the position of the gas valve 16 and/or the speed of the combustion air blower 22 to obtain a desired result.

In another embodiment, burner system 10 may include a temperature sensor 32*a* positioned near the combustion chamber, as described above. Temperature sensor 32*a* is in communication with thermostat 30 and sends signals to thermostat 20 related to the temperature of the combustion chamber. Based on the signals from temperature sensor 32*a*, thermostat 30 sends signals to control 18 related to a demand for heat.

The appliance in which the burner system 10 is used may be combined with an exhaust hood 40 to remove and direct products of combustion to an appropriate location, such as to the outside environment. The exhaust hood 40 may be an integral part of the appliance, or it may be a separate unit. Exhaust hood 40 may include a fan 42 that facilitates removing the products of combustion from the appliance. In one embodiment, the exhaust fan 42 is a variable speed fan that may be operated in cooperation with the gas valve 16 and the combustion air blower 22 to provide enhanced performance of the burner system 10 in response for a demand for a desired heat output. Accordingly, the variable speed exhaust fan 42 may be in communication with the control 18, whereby signals from the control 18 may be sent to the exhaust fan 42 to cause the fan to operate at a desired speed. Likewise, signals may be communicated from the exhaust fan 42 to the control 18 which are related to the speed of the exhaust fan 42.

In another embodiment, a sensor 44 may be positioned within the exhaust hood 40 and may be in communication with the control 18, whereby signals from the sensor 44 may be used to control the speed of the exhaust fan 42. For example, the sensor 44 may be configured to sense a temperature of the exhaust within the exhaust hood 40, and to send signals to the control 18 related to the sensed temperature. Alternatively, sensor 44 may be configured to sense the presence of carbon monoxide and/or carbon dioxide and, optionally, the temperature within the exhaust hood 40, and to send signals to the control 18 related to the sensed presence of carbon monoxide, carbon dioxide, or the sensed temperature. In response to the signals from the sensor 44, the control 18 may direct a change in the speed of the exhaust fan 42.

In another embodiment, the appliance in which the burner system 10 is used may include an air circulating fan 46 for moving air heated by the burner 14. For example, the air circulating fan 46 may be used to circulate heated air through the cooking chamber of an oven with which the burner system 10 is used. The air circulating fan 46 may be controllable to adjust the speed of the fan and may be in communication with the control 18 such that the control 18 sends signals to the air circulating fan 46 to obtain a desired fan speed, thereby achieving a desired air flow. The air circulating fan 46 may also send signals to the control 18 related to the speed of the fan. Because the speed of the fan 46 may affect the flow of air from the combustion air blower 22, the control 18 may operate the combustion air blower 22 and the air circulating fan 46, and optionally the exhaust fan 42, cooperatively to obtain a desired air flow to the burner 14 to correspond to a particular position of the gas valve 16.

In another embodiment, the burner system 10 may be configured for self-calibration and/or operation in a learning mode relative to the variable speed combustion air blower 22. In the event that the speed of the combustion air blower 22 changes over time in response to a given input voltage from the control 18, the combustion air blower speed desired for use with a particular gas valve position in response to input from the thermostat 30 may not be achieved consistently. Because the system 10 includes a speed sensor 26 associated with the variable speed combustion air blower 22, signals may be sent by the speed sensor 26 to the control 18 such that the control 18 will recognize that the actual speed of the combustion air blower 22 does not correspond with the desired speed. The control 18 may thereafter adjust the voltage supplied to the combustion air blower 22 to cause the blower speed to adjust to the desired setting. The burner system 10 may be configured to calibrate the voltages associated with the desired combustion air blower speeds such that the voltages corresponding to desired blower speeds are known across the entire operating range of the burner system 10. The control 18 may thereafter store these voltages in a memory, such as in the look-up table described above. The control 18 may also monitor signals from the speed sensor 26 and make periodic adjustments to the values stored in the table, for example when the speed of the combustion air blower 22 in response to a given command for a desired speed changes over time. The control 18 will therefore ensure efficient operation of the burner system 10 over time.

In another embodiment, the control 18 may be configured to sense a stall condition of the combustion air blower 22 when a very low voltage is directed to the combustion air blower 22 in response to a given heat demand. The control 18 will store the value associated with the stall condition of the combustion air blower 22 and will avoid operating below that voltage during operation of the burner system 10. Voltage to the combustion air blower 22 will then be increased to overcome the stall condition.

Figure 2:
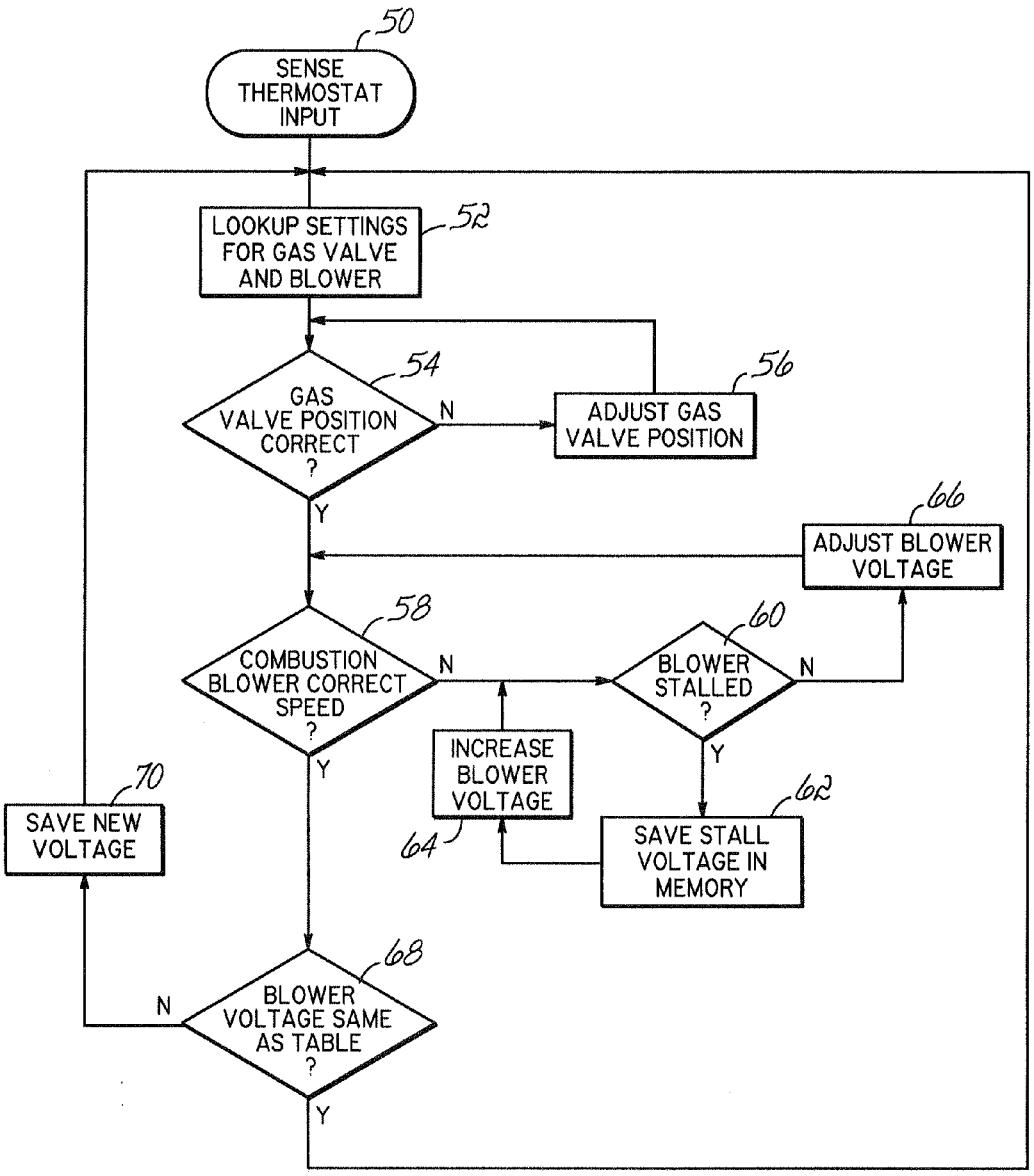
FIG. 2 is a flowchart depicting an exemplary operation of the burner system of FIG. 1.

FIG. 2 is a flow chart illustrating an exemplary operation of the burner system 10 of FIG. 1. At 50, control 18 receives an input related to a heat demand of the burner system 10. At 52 and 54, control 18 verifies whether the current position of the gas valve 16 corresponds to the thermostat input. If the position of gas valve 16 is not correct, control 18 will adjust the gas valve position at 56 and then re-verify whether the adjusted gas valve position is correct. When the gas valve position is correct, the control 18 will verify whether the speed of the combustion air blower 22 is correct at 58. If the speed of the combustion air blower 22 is not correct, control 18 will determine whether a stall condition has occurred (blower speed is zero) at 60. If the combustion air blower 22 has stalled, control 18 will save the stall value of the voltage applied to the combustion air blower 22 in memory at 62. The voltage provided to the combustion air blower 22 will then be increased at 64.

Control 18 will then re-check to see if the combustion air blower 22 is still stalled at 60. If the combustion air blower 22 is not stalled, control 18 will incrementally adjust the speed of the combustion air blower 22 at 66 and then re-check the combustion air blower 22 speed to verify whether the desired speed has been attained at 58. If the combustion air blower 22 speed matches the desired speed, control 18 will determine whether the value of the voltage required to attain the desired speed is different from the value stored in memory for that desired speed at 68. If the value has changed, the new voltage value corresponding to that desired speed will be stored in member at 70. The system 10 is then ready to receive a new input command from the thermostat 30.

During operation of the burner system 10, the control 18 will receive commands from the thermostat 30 for various heat demands required by the appliance in which the burner system 10 is used. When a demand for lower heat is received from the thermostat 30, the control 18 must adjust the gas valve 16 and combustion air blower 22 to reduce the heat output from the burner system 10. Generally, adjustment of the gas valve 16 can occur much more rapidly than adjustment of the combustion air blower speed, as the combustion air blower 22 will gradually reduce speed from a high heat output condition to a low heat output condition. If the gas valve 16 is moved too quickly relative to the changing speed of the combustion air blower 22, a lean condition of the air/gas mixture may result and potentially cause the burner flame to go out.

In one embodiment, the burner system 10 is configured such that the position of the gas valve 16 from a first position, corresponding to a high heat output, to a second position, corresponding to a low heat output, is gradually changed in a manner that tracks the gradually reducing speed of the combustion air blower 22 from a first speed, corresponding to the high heat output, to a second speed, corresponding to the low heat output. In this embodiment, the speed of the combustion air blower 22 is constantly monitored and signals are provided to the control 18 from the speed sensor 26. The control 18 adjusts the position of the gas valve 16 between the first and second positions such that the gas valve 16 position tracks the gradual reduction in speed of the combustion air blower 22 to thereby maintain substantially stoichiometric conditions as the system 10 moves to the lower heat output condition.

To avoid too long of a delay in obtaining the desired heat rate, and therefore avoiding an overshoot of the desired lower heat output, the control 18 may rapidly move the gas valve 16 to the second position when the gas valve 16 is within a particular range of the desired second position. For example, when the gas valve 16 is within 10% of the desired position, the control 18 may rapidly move the gas valve 16 to the second position as the combustion air blower 22 continues to reduce speed to the second blower speed.

Figure 3:
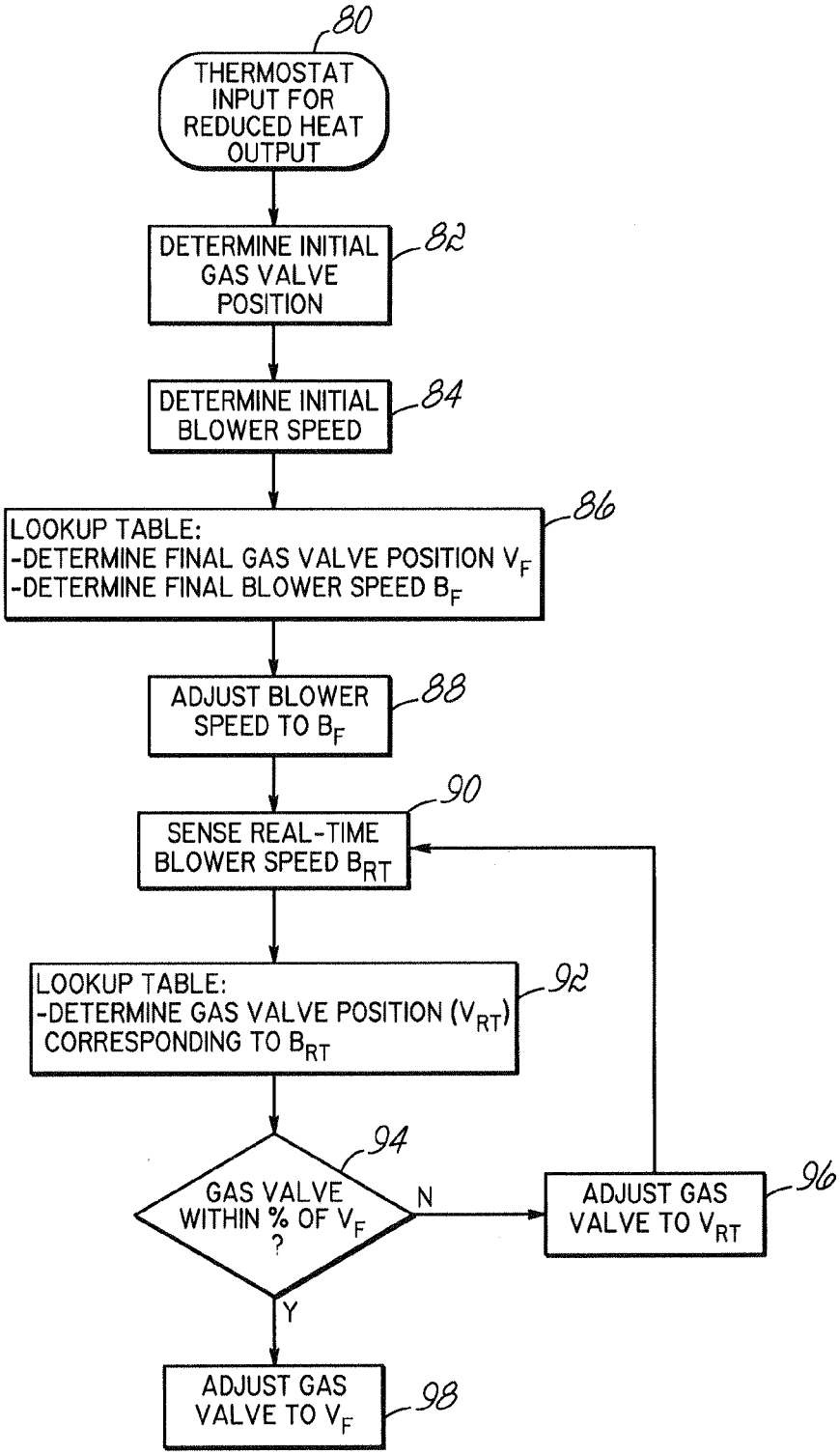
FIG. 3 is a flowchart depicting an exemplary operation of the burner of FIG. 1, when the thermostat input requests a reduced heat output.

FIG. 3 is a flow chart illustrating an exemplary operation of the burner system 10 of FIG. 1 when the thermostat 30 provides an input command to the control 18 for reduced heat output. At 80, control 18 receives an input from the thermostat 30 related to a reduced heat demand of the burner system 10. Control 18 verifies the initial position (Vo) of the gas valve 16 (by verifying the voltage supplied to solenoid 20, for example) and verifies the initial speed (Bo) of the combustion blower 22 at 82 and 84, respectively. At 86, the control 18 determines the final position (VF) of the gas valve 16 and the final speed (BF) of the combustion blower 22 corresponding to the thermostat input at 80. Control 18 then reduces voltage to the combustion blower 22 at 88, whereafter the combustion blower 22 will gradually decrease in speed toward the final speed (BF).

At 90, sensor 26 senses the actual speed of combustion air blower 22 in real time (BRT) and sends signals related to the real time speed (BRT) to control 18. At 92, control 18 determines the gas valve position (VRT) required to maintain substantially stoichiometric conditions with the real time combustion air blower speed (BRT). At 94, control 18 determines whether the current gas valve position is within a predetermined range of the final gas valve position (VF). If the current gas valve position is not within the predetermined range, control 18 will adjust the gas valve 16 to the real time position (VRT) at 96. Control 18 will then cycle back through sensing the real time combustion air blower speed (BRT), determining the real time gas valve position (VRT), and determining whether the current gas valve position is within a predetermined range of the final gas valve position (VF). When the current gas valve position is within the predetermined range, control 18 will cause the gas valve 16 to rapidly move to the final gas valve position (VF) at 98.

Figure 4:
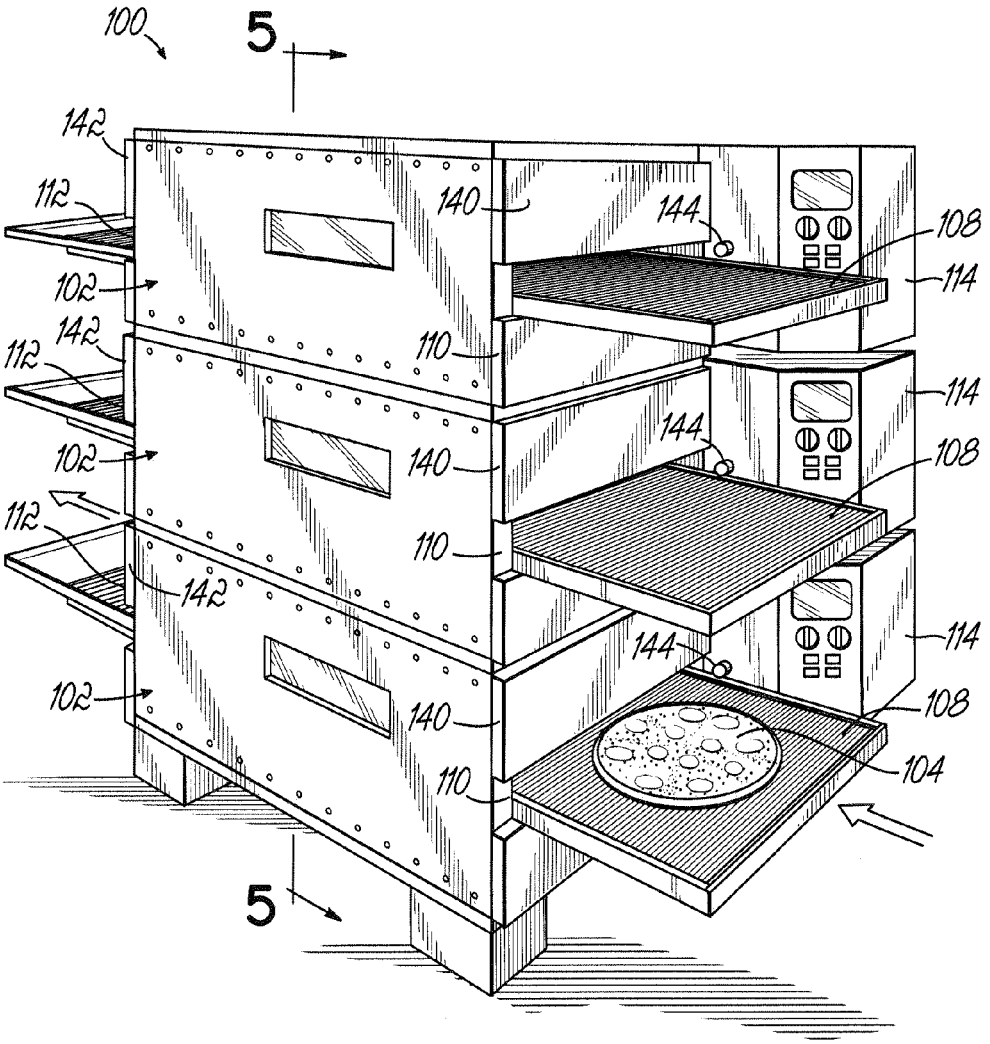
FIG. 4 is a perspective view of an exemplary conveyor oven utilizing a burner system in accordance with the principles of the present invention.
Figure 5:
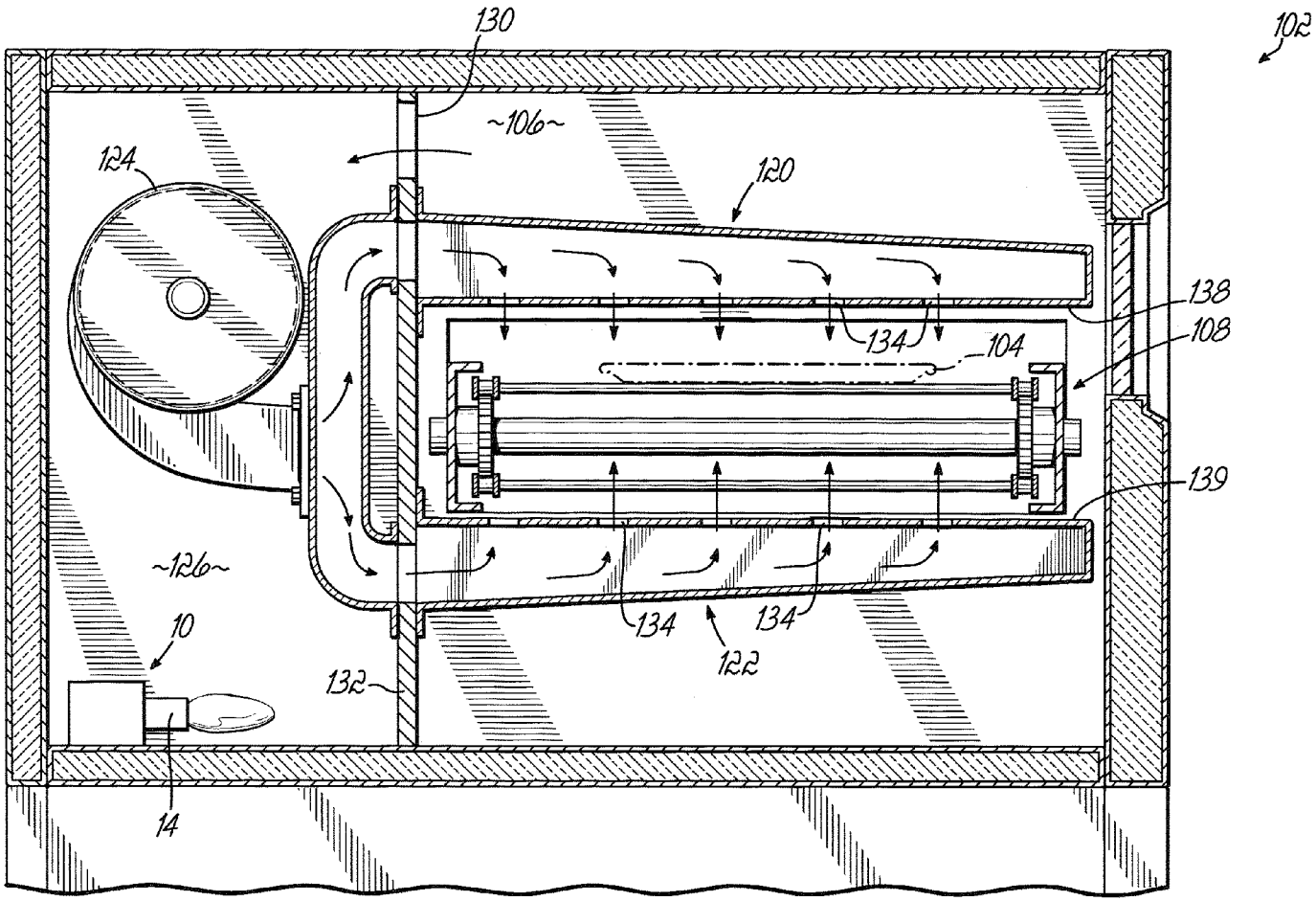
FIG. 5 is a partial cross-sectional view of the conveyor oven of FIG. 4, taken along line 5-5.

With continued reference to FIG. 1, and referring further to FIGS. 4 and 5, a burner system 10 as described above may be incorporated into a cooking appliance, such as a conveyor oven 100. The conveyor oven 100 may include one or more cooking "decks" 102 for cooking food products 104 that are moved through cooking chambers 106 of decks 102 on conveyors 108 associated with each deck 102. In the embodiment shown, the conveyor oven 100 comprises three decks 102, each deck 102 having an associated cooking chamber 106 and a conveyor 108 which moves food products 104 from a first end 110 of the deck 102, through the cooking chamber 106, to an exit at a second end 112 of the deck 102. Each deck 102 further includes at least some of the components of a burner system 10, as described above. Each deck 102 may further include a control panel 114 having features for inputting commands to operate the deck 102 and for displaying information to operators related to operation of the deck 102.

Referring particularly to FIG. 5, each deck 102 comprises a cooking chamber 106 through which the conveyor 108 extends. Heated air is provided to the cooking chamber 106 and is directed to food products 104 moving through the cooking chamber 106 on the conveyor 108 by upper and lower air circulating fingers 120, 122 disposed above and below the conveyor 108 respectively. Heated air is provided to the fingers 120, 122 by an air-circulating blower 124 disposed in a compartment 126 that is separate from the cooking chamber 106. The compartment 126 may also house a burner system 10 as described above. Heated air from within the cooking chamber 106 is drawn into the compartment 126 through one or more apertures 130 formed through a wall 132 that separates cooking chamber 106 from the compartment 126. Air from cooking chamber 106 and hot air from the burner 14 is then drawn into the air-circulating blower 124 for distribution to the air circulating fingers 120, 122. Each air-circulating finger 120, 122 includes a plurality of apertures 134, 136 on respective side surfaces 138, 139 that face the conveyor 108 to direct heated air to the food products 104 moving through the cooking chamber 106. While not specifically depicted in FIG. 4, the conveyor oven 100 may be combined with an exhaust hood 40, as illustrated in FIG. 1, to remove heat, grease, smells, and products of combustion from the oven 100.

In one embodiment, the air-circulating blower 124 is a variable speed blower and is electrically coupled to the control 18 of the burner system 10 as described above. The control 18 may therefore speed up or slow down the air circulating blower 124 to increase or decrease the flow rate of air provided to the air circulating fingers 120, 122 and directed to food products 104 passing through the cooking chamber 106 on the conveyor 108. Accordingly, the control 18 may adjust the speed of the air-circulating blower 124 to vary the flow rate of air to suit cooking of various food products 104. The speed of the air-circulating blower 124 may also be coordinated with the speed of the conveyor 108 through the cooking chamber 106 to finely tune the cooking performance of the oven 100.

In another embodiment, the air-circulating blower 124 of the oven deck 102 may be controlled to cooperate with the combustion air blower 22 of the burner system 10 to provide a desired air/gas ratio to the burner 14. Because the air-circulating blower 124 may cause an induced draft through the burner 14, the control 18 may operate to control the air circulating blower 124 of the oven deck 102 to cooperate with the combustion blower 22 of the burner system 10 such that a desired gas/air ratio is provided to the oven 100. Burner system 10 may therefore include a memory having a look-up table which includes various speed settings for the air circulating blower 124 across the operating range of the burner system 10 and corresponding to the various gas valve 16 positions and combustion air blower 22 speeds. The desired speeds of the air circulating blower 124 may be determined experimentally by operating the burner system 10 and oven deck 102 at various settings. In another aspect, the control 18 may direct the air circulating blower 124 to stop or to operate at a reduced speed when the heat demand required of the burner system 10 is low, such as when few or no food products 104 are being cooked in the oven deck 102, but it is nevertheless desired to maintain the oven deck 102 in a stand-by condition in the event that demand for food products 104 increases. This configuration is beneficial for use in restaurants, for example, when the demand for food is low, such as during off-peak hours. In the stand-by condition, energy and fuel demands on the oven 100 are low, thereby saving energy and money.

In another embodiment, the oven 100 is used with an exhaust hood 40 having a variable speed fan 42 as described above. The control 18 of the burner system 10 is in communication with the variable speed exhaust fan 42 and controls the variable speed exhaust fan 42 to provide efficient operation of the oven 100. For example, when the heat demand of the oven 100 is high, the variable speed exhaust fan 42 may be operated at a relatively high speed to facilitate the removal of heat, grease, smells, and combustion products from the oven 100. Likewise, when the heat demand of the oven 100 is low, the variable speed exhaust fan 42 may be operated at a relatively low speed to help conserve heat within the oven 100 while still removing grease, smells and products of combustion. In another embodiment, the variable speed exhaust fan 42 may be operated at a relatively high speed when multiple decks 102 of the oven 100 are in use, and may be operated at a relatively low speed when fewer than all the decks 102 are in use.

Because the exhaust fan 42 not only draws air from the oven 100, but also from the surrounding environment in which the oven 100 is used, such as a restaurant, selective control of the exhaust fan 42 may also conserve energy used by the restaurant by minimizing excess air drawn from the restaurant. For example, if the temperature of the restaurant is heated or cooled to provide comfort to persons in the restaurant, selective operation of the exhaust fan 42 prevents excessive air from being drawn through the exhaust hood 40 which would otherwise unnecessarily increase the energy required to maintain the restaurant at the desired temperature. The exhaust fan 42 may also be operated in a stand-by condition corresponding to a period of non-use or very low demand on the oven 100, as described above.

The variable speed exhaust fan 42 may also be operated by the control 18 in cooperation with one or more of the air circulating blower 124, the combustion air blower 22, the gas valve 16, and the conveyor 108 to finely tune operation of the oven 100 for various conditions or cooking requirements.

In another embodiment, the oven 100 may include front and rear doors or gates 140, 142 at the first and second ends 110, 112 of each oven deck 102, as depicted in FIG. 4. The positions of the doors 140, 142 relative to the conveyors 108 are adjustable to increase or decrease the openings to the cooking chambers 106 through which the conveyors 108 extend, thereby controlling the amount of heat exchange between the cooking chambers 106 and the environment. Operation of the burner system 10, the air circulating blower 124, and the exhaust fan 42, may be controlled in cooperation with the positions of the front and rear doors 140, 142. For example, when the oven 100 is first started or when no food products 104 are being cooked by the oven 100, the front and rear doors 140, 142 of each deck 102 may be placed in closed positions to conserve heat within the oven 100. The burner system 10, the air circulating blower 124, and the exhaust fan 42 may be operated by the control 18 to provide desired operation of the oven 100 in response to commands from the thermostat 30.

The oven 100 may further include sensors 144 associated with each deck 102 and positioned adjacent the front and rear doors 140, 142 to sense the presence of a food product 104 on the conveyor 108. When the food product 104 is placed on the conveyor 108 at the first end 110 of the oven deck 102, the sensor 144 detects the food product 104 and sends a signal to the control 18 which in turn actuates the front door 140 to an open position, thereby admitting the food product 104 into the cooking chamber 106. The rear door 142 may also be opened, or may remain closed until a second, optional sensor (not shown) located adjacent the rear door 142 detects the presence of the food product 104 adjacent the rear door 142, whereafter the rear door 142 may be opened to allow the food product 104 to exit the second end of the oven deck 102. The front door 140 may be closed after the food product 104 has been admitted into the cooking chamber 106, to conserve heat within the cooking chamber 106, or the front door 140 may remain open for a period of time and then close if no other food products 104 are detected by the sensor 144. Based upon various conditions of the front and rear doors 140, 142 (both doors open, both doors closed, or one of the front and rear doors open) the control 18 may adjust the operation of the burner system 10, the air circulating blower 22, and/or the exhaust fan 42 to provide a desired operation of the oven 100. Data corresponding to these various operating conditions may be stored in a memory for access by control.

While the present invention has been illustrated by the description of exemplary embodiments thereof, and while the embodiments have been described in considerable detail, they are not intended to restrict or in any way limit the scope of the appended claims to such detail. Additional advantages and modifications will readily appear to those skilled in the art. As a non-limiting example, while operation of a burner system 10 has been described herein as including a look-up table in a memory for use by control 18 to determine desired settings for gas valve 16 and combustion air blower 22, it will be appreciated that control 18 may alternatively be configured to calculate desired gas valve positions and combustion air blower speeds corresponding to substantially stoichiometric conditions for various heat demands. Moreover, the various features disclosed herein may be used alone or in any desired combination. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A power burner system for use with a heating appliance having an air circulating fan, the burner system comprising:

a burner tube;

a gas valve adapted to receive gas from a supply and to provide gas to said burner tube, said gas valve adjustable to a plurality of positions to provide gas at a controlled rate;

a variable speed combustion air blower operatively coupled to said burner tube and adapted to mix air with the gas from the supply; and a control communicating with said gas valve and said combustion air blower, said control operative to modulate said gas valve and said combustion air blower to control gas flow from said gas valve and air flow from said blower to maintain substantially stoichiometric conditions of the air and gas flow into said burner tube;

wherein said modulation is based at least in part on a speed of the air circulating fan.

2. The burner system of claim 1, wherein the air circulating fan is a variable speed air circulating fan, and wherein said controller is adapted to communicate with the air circulating fan and to control a speed of the air circulating fan as a function of a heat demand of the system.

3. The burner system of claim 1, wherein the heating appliance is used with a variable speed exhaust fan, and wherein:

said controller is adapted to communicate with the exhaust fan and to control a speed of the exhaust fan as a function of a heat demand of the system.

4. The burner system of claim 1, further comprising:

a sensor operative to sense a speed of said combustion air blower and to send signals to said control related to said sensed speed;

wherein said control further modulates said combustion air blower in response to said signals from said sensor to achieve a desired speed related to the stoichiometric conditions of said burner.

5. The burner system of claim 4, wherein said control further modulates said gas valve as a function of said sensed blower speed in response to a demand for reduced heat output.

6. The burner system of claim 5, wherein said control modulates said gas valve as a function of said sensed blower speed until said gas valve is within a predetermined range of a desired gas valve position corresponding to the reduced heat output, whereafter said control moves said gas valve directly to said desired gas valve position.

7. The burner system of claim 6, wherein said gas valve is moved directly to said desired gas valve position when said gas valve position is within 10 percent of said desired gas valve position.

8. The burner system of claim 1, wherein:

said control receives signals related to the operation of at least one of said gas valve, said combustion air blower, the air circulating fan, or an exhaust fan;

said control is adapted to control at least one of said gas valve, said combustion air blower, the air circulating fan, or the exhaust fan to maintain combustion at a substantially stoichiometric condition; and said control stores information related to the operation of at least one of said gas valve, said blower, the air circulating fan, or the exhaust fan and corresponding to the substantially stoichiometric condition.

9. A power burner system for use with a heating appliance having an air circulating fan, the burner system comprising:

a burner tube;

a gas valve adapted to receive gas from a supply and to provide gas to said burner tube, said gas valve adjustable to a plurality of positions to provide gas at a controlled rate;

a variable speed combustion air blower operatively coupled to said burner tube and adapted to mix air with the gas from the supply; and a control communicating with said gas valve and said combustion air blower, said control operative to modulate said gas valve and said combustion air blower to control gas flow from said gas valve and air flow from said blower to maintain substantially stoichiometric conditions of the air and gas flow into said burner tube;

wherein said modulation is related to a speed of the air circulating fan;

wherein the heating appliance is used with a variable speed exhaust fan, and;

a sensor configured to generate a signal related to a condition of exhaust proximate the exhaust fan;

said controller adapted to control a speed of the exhaust fan as a function of the signal generated by said sensor.

10. A power burner system for use with a heating appliance having an air circulating fan, the burner system comprising:

a burner tube;

a gas valve adapted to receive gas from a supply and to provide gas to said burner tube, said gas valve adjustable to a plurality of positions to provide gas at a controlled rate;

a variable speed combustion air blower operatively coupled to said burner tube and adapted to mix air with the gas from the supply;

a control communicating with said gas valve and said combustion air blower, said control operative to modulate said gas valve and said combustion air blower to control gas flow from said gas valve and air flow from said blower to maintain substantially stoichiometric conditions of the air and gas flow into said burner tube;

wherein said modulation is related to a speed of the air circulating fan;

a sensor operative to sense a speed of said combustion air blower and to send signals to said control related to said sensed speed;

wherein said control further modulates said combustion air blower in response to said signals from said sensor to achieve a desired speed related to the stoichiometric conditions of said burner; and a memory configured to store information related to a voltage corresponding to said sensed speed of said combustion air blower.

11. The burner system of claim 10, wherein said memory is configured to store information corresponding to a stall condition of said blower.

* * * * *